United States Patent [19]

Fiordellisi et al.

[11] Patent Number: 4,544,189

[45] Date of Patent: Oct. 1, 1985

[54] LATCH RELEASE ARRANGEMENT

[75] Inventors: Stephen J. Fiordellisi, Warren; Bela Gergoe, Birmingham; John W. Hamilton, Dearborn, all of Mich.

[73] Assignee: General Motors Corporation, Detroit, Mich.

[21] Appl. No.: 570,005

[22] Filed: Jan. 11, 1984

[51] Int. Cl.[4] ..... E05C 13/06

[52] U.S. Cl. ..... 292/50; 292/336.3; 292/DIG. 43; 292/DIG. 25

[58] Field of Search ..... 292/50, 336.3, 28, 38, 292/DIG. 43, DIG. 23, DIG. 25; 296/146

[56] References Cited

U.S. PATENT DOCUMENTS 3,177,022 4/1965 McKee et al. ..... 292/50
3,875,772 4/1975 Ebersman et al. ..... 292/38 X
4,249,771 2/1981 Gergoe et al. ..... 292/263
4,350,384 9/1982 Yasuda ..... 292/DIG. 43 X

FOREIGN PATENT DOCUMENTS 760914 12/1933 France ..... 292/50
2478717 9/1981 France ..... 292/50

*Primary Examiner*—Richard E. Moore
*Attorney, Agent, or Firm*—Herbert Furman

[57] ABSTRACT

A latch release arrangement for vehicle bodies which includes drive and driven members interconnected by a flexible cable for conjoint rotation. A key operated member releases the first latch directly or actuates the drive member to release the second latch through the driven member. An actuator can also operate the drive member to release the second latch through the driven member.

3 Claims, 12 Drawing Figures

LATCH RELEASE ARRANGEMENT

This invention relates to a latch release arrangement for vehicle bodies and more particularly to such an arrangement for selectively releasing a plurality of vehicle body latches.

Certain vehicle bodies such as station wagons include a tailgate which is hinged at its upper edge to the body for movement between open and closed positions with respect to a rear body opening. The lower edge of the tailgate mounts a first latch for latching the tailgate to the body in the closed position. The tailgate has a window opening and a window is hinged at its upper edge to a corresponding edge of the window opening for movement between open and closed positions. A second latch on the tailgate is engageable with a cooperating striker on the lower edge of the window to lock the window in closed position. It is desirable that the first and second latches be releasable selectively and alternately of each other from the exterior of the vehicle and that the first latch be remotely releasable from the interior of the vehicle such as by a driver or passenger.

The latch release arrangement of this invention is intended for use with first and second latches. The arrangement releases the first latch from the exterior of the body by a key operated member independently of release of the second latch to release the tailgate for movement to open position with the window closed. The key operated member releases the second latch independently of release of the first latch to release the window for movement to open position with the tailgate closed. The arrangement includes an actuator remotely controlled by the driver or passenger to release the second latch independently of operation of the key operated member. In the preferred embodiment, the arrangement includes driven and drive members rotatably mounted on the tailgate and respective to the first and second latches. The drive and driven members are interconnected by a first flexible cable member which is at least partially wrapped around the periphery of each member so that rotation of the drive member conjointly rotates the driven member. A key operated rotatable member is engageable with the drive member upon rotation of the key operated member in one direction to conjointly rotate the drive member and the driven member and release the first latch. The key operated member is rotatable in the other direction to directly release the first latch and not engage the drive member. An actuator is connected to a second flexible cable member which is wrapped around the drive member in a direction opposite the direction of wrapping of the first cable member. The second cable member has an abutment which is engageable with an abutment on the drive member to rotate the drive member in the one direction. The drive member abutment moves apart from the second cable member abutment when the drive member is rotated by the key operated member so that the actuator remains in a non-operating mode. When the drive member is actuated by the actuator, the second cable member abutment engages the drive member abutment to rotate the drive member and conjointly rotate the driven member. Thus, the latch release arrangement is very simple and compact and yet provides selective and alternate release of the first latch from the exterior or interior of the vehicle by the key operated member or actuator independent of release of the second latch. The arrangement also provides release of the first latch from the exterior of the body by a key operated member, independently of release of the second latch.

The primary feature of this invention is that it provides an improved latch release arrangement for selectively and alternately releasing first and second vehicle body latch means to provide selective and alternate movement to open position of a vehicle body closure and a window mounted on such closure. Another feature is that the latch release arrangement permits (1) the closure first latch means to be released from the exterior of the vehicle by a key operated member, or from the interior of the vehicle by a remotely controlled actuator and (2) the window second latch means to be released only from the exterior of the body and alternately of the closure first latch means by the key operated member. A further feature is that the latch release arrangement includes rotatable drive and driven members which are connected for conjoint rotation by a first flexible cable member wrapped at least partially around the annular peripheries of each member and secured thereto. Yet another feature is that the actuator includes a second cable member securable to the drive member through the engagement of abutment means on both. Yet a further feature is that the drive member is rotatable by the key operated member only upon rotation of the key operated member in one direction and the window second latch means is directly released by the key operated member upon rotation thereof in an opposite direction such that the key operated member must be rotated in opposite directions to release the first closure and second window latch means.

These and other features of the invention will be readily apparent from the following specification and drawings wherein:

FIG. 1 is a rear view of a station wagon type of vehicle body having a tailgate movable between open and closed positions with respect to a rear body opening, a window mounted on the tailgate for movement between open and closed positions with respect thereto, first and second latch means respective to the tailgate and the window for locking them in closed position, and a latch release arrangement according to this invention for releasing the first and second latch means.

Figure 1:
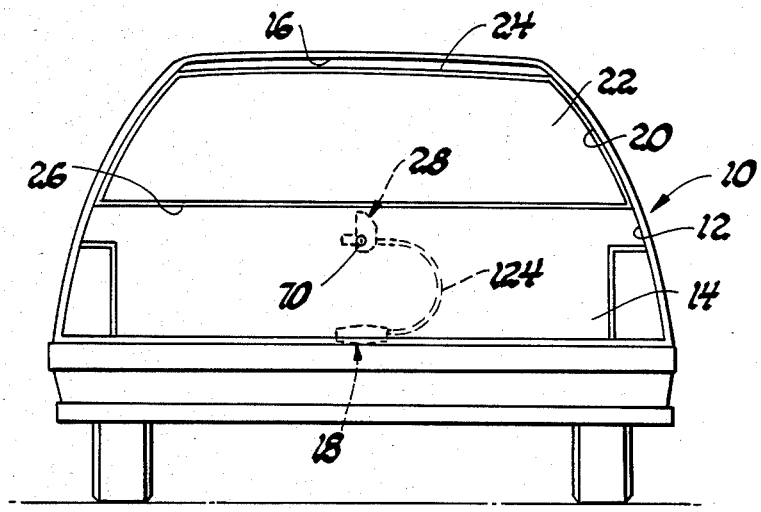

Referring now to FIG. 1 of the drawings, a station wagon type of vehicle 10 includes a rear body opening 12 which is opened and closed by a tailgate 14. The upper edge 16 of the tailgate 14 is conventionally hinged to the body for movement of the tailgate from closed position, as shown, to open position, not shown. The tailgate is latched to the body in closed position by a first or closure latch 18 mounted on the lower edge of the tailgate. Latch 18 is conventional and includes a detented fork type bolt which is engageable in latched position with a striker pin on the lower edge of the body opening 12. A latch of this type is well known and therefore is not shown.

The gate 14 includes a window opening 20 which is opened and closed by a rear window 22 conventionally hinged at its upper edge 24 to the upper edge of the opening 20 and latched at its lower edge 26 to the lower edge of the opening by a second or window latch 28.

Figure 2:
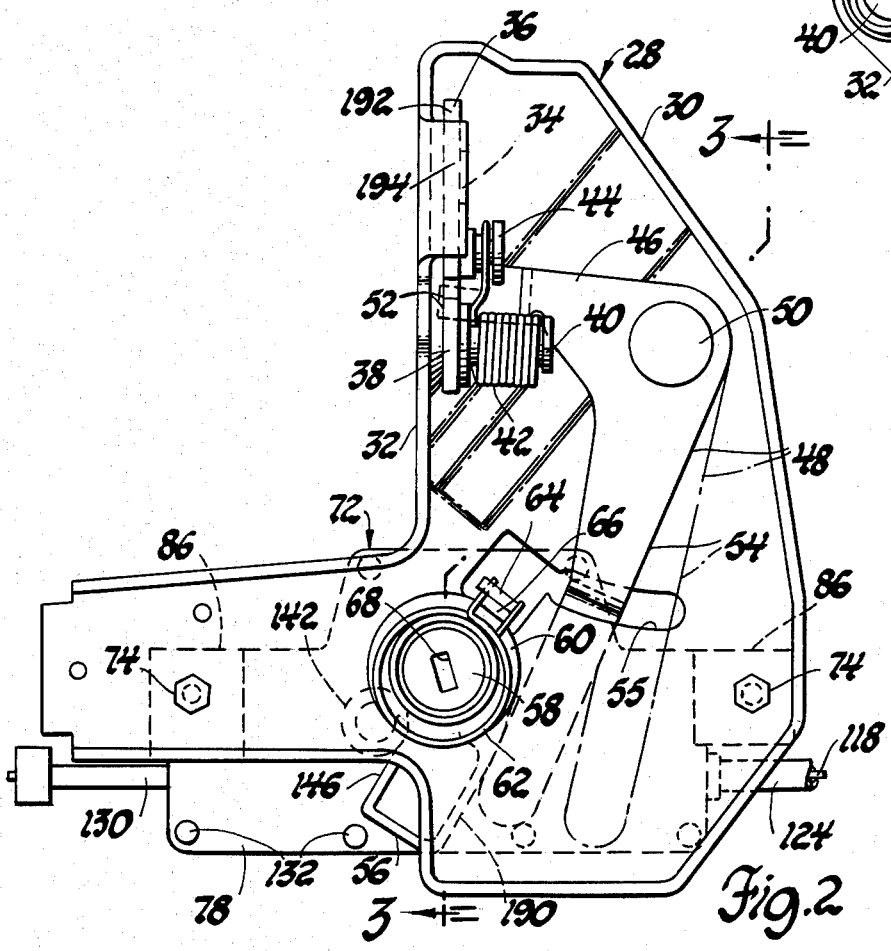
FIG. 2 is an enlarged view of the window second latch means of FIG. 1.
Figure 3:
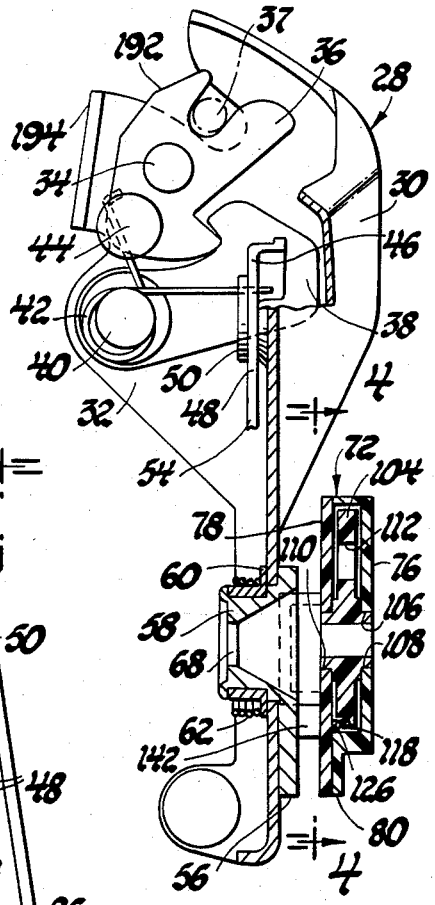
FIG. 3 is a view taken along the line 3—3 of FIG. 2.
Figure 4:
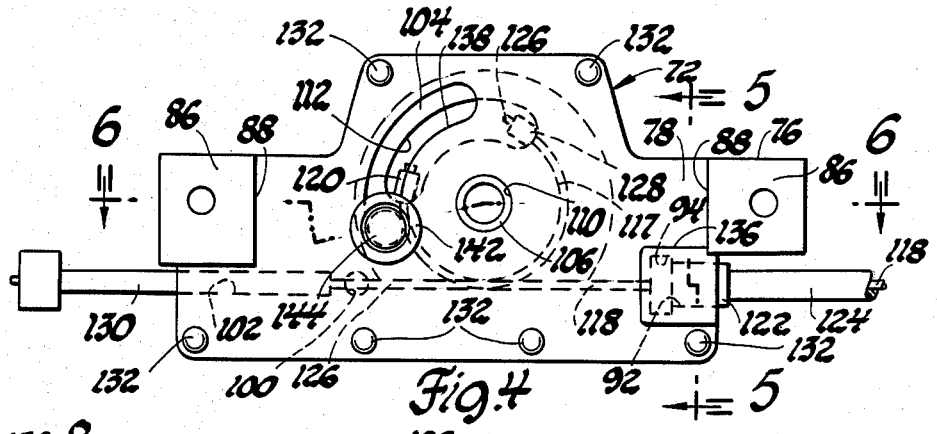
FIG. 4 is a view taken along line 4—4 of FIG. 3 showing the drive member.

As shown in FIGS. 2 and 3, the latch 28 includes a peripherally flanged main frame 30 which is mounted on the tailgate 14 in a conventional manner adjacent the lower edge of the window opening 20. A side frame 32 of the latch, generally located in the plane of the center line of the vehicle, pivotally mounts at 34 a fork type bolt 36. The bolt is engageable in latched position, as shown in FIGS. 2 and 3, with a conventional U-type striker 37 conventionally secured to the window 22 adjacent lower edge 26 thereof. The bolt 36 is held in latched position against counterclockwise movement, as viewed in FIG. 3, to unlatched position by a hook type detent 38 pivoted to side frame 32 by a shouldered pin 40. A coil torsion spring 42 surrounds the pin 40 and has one leg thereof engaging a pin abutment 44 secured to the bolt 36 and the other leg thereof engaging a notch in the lower edge of an offset leg 46 of a release lever 48, FIG. 2, pivoted at 50 to the side frame 30. Leg 46 includes a tab 52, FIG. 2, engaging within an opening in detent 38 to bias the detent counterclockwise, FIG. 3, to detented position. An offset leg 54 of lever 48 extends through and moves within a slot 55 in the main frame 30.

A cam member 56 has a shouldered hub 58 rotatably journaled in an opening in the main frame 30 and secured in place by spinning the end of the hub over a flanged bushing 60. A coil torsion spring 62 surrounds the bushing and has the free legs thereof engaging juxtaposed lateral tabs 64 and 66 of the member 56 and the frame 30. The spring locates the member 56 in a non-operating position, as shown, and resists movement thereof in a clockwise direction to a first operating position or counterclockwise to a second operating position as will be described. The hub 58 of the member 56 includes a rectangular slot 68 which slidably receives the free end portion of a link, not shown, the other end of which is conventionally connected to an outside key cylinder 70, FIG. 1. Insertion of a key into the cylinder 70 and rotation of the key cylinder barrel in opposite directions results in rotation of member 56 in corresponding clockwise or counterclockwise directions to first and second operating positions.

Figure 5:
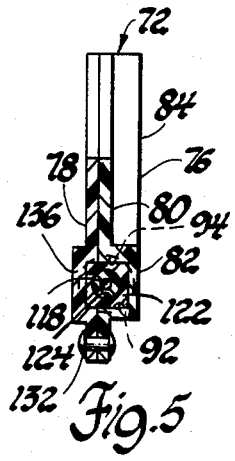
FIG. 5 is a sectional view taken along line 5—5 of FIG. 4.
Figure 6:
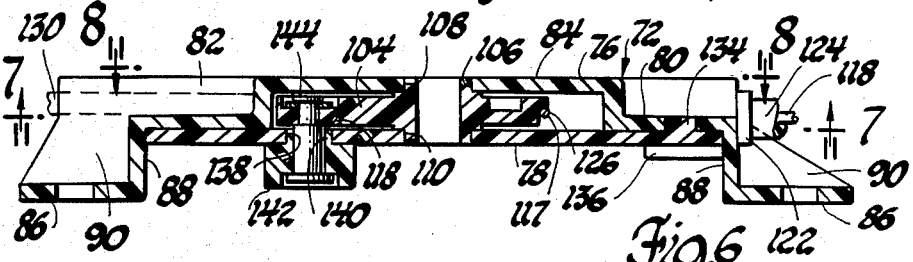
FIG. 6 is a sectional view taken along line 6—6 of FIG. 4.
Figure 7:
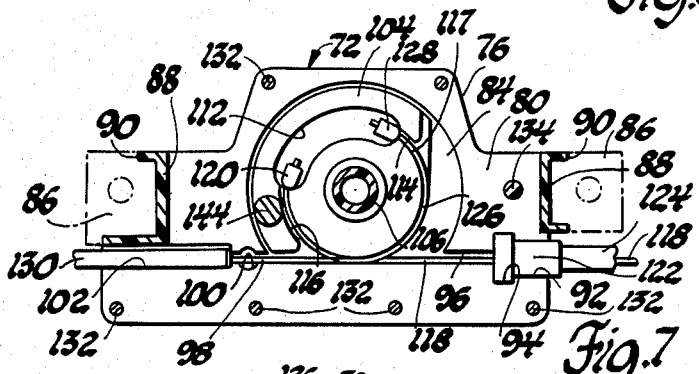
FIG. 7 is a view taken along line 7—7 of FIG. 6.
Figure 10:
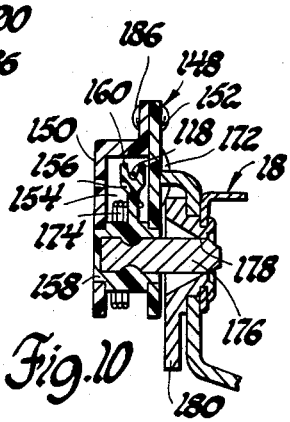
FIG. 10 is a sectional view taken along line 10—10 of FIG. 9.
Figure 8:
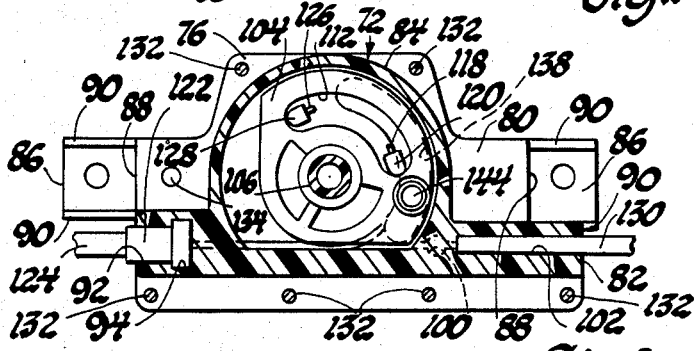
FIG. 8 is a view taken along line 8—8 of FIG. 6.

Referring now to FIGS. 2 through 8, inclusive, a first housing 72 of plastic material is bolted at 74 to the main frame 30. This housing includes a base member 76 and a secondary member 78. The base member 76 includes a generally planar wall 80 having an elongated integral U-shaped cross-section outwardly offset rib 82 opening inwardly thereof and an integral generally semi-circular shaped outwardly offset recess 84 which also opens inwardly thereof. The outer walls of rib 82 and recess 84 are coplanar. A pair of mounting pads 86 are offset inwardly of wall 80 and connected thereto by integral lateral flanges 88 and reinforcing flanges 90. The mounting pads 86 bear against the frame 30 and are bolted thereto at 74. As best shown in FIGS. 5 and 7, the inwardly opening rib 82 includes a square shaped section 92 joined to a semi-circular groove 94. The groove 94 joins to a narrow passage 96 which communicates with the recess 84. Aligned with the passage 96 is a passage 98 which traverses a cylindrical recess 100 and joins to a square shaped cross-section groove 102. The passage 98, recess 100 and groove 102 are also part of rib 82.

A sector drive member 104 of plastic material has an integral shouldered hub 106 rotatably received in a circular opening 108 of recess 84 and an aligned circular opening 110 of secondary member 78 to rotatably mount the drive member 104 in the housing 72. The drive member includes a closed arcuate slot 112 therethrough and grooves 114 and 116 in the inner surface thereof which join the flanged outer circular periphery 117 of the drive member, FIGS. 6 and 7, to the slot 112. A first flexible cable is partially wrapped around drive member 104. The cable 118 extends around periphery 117 and through the groove 116 into the slot 112 where its free end has secured thereto an abutment 120 engageable with one closed end of the slot 112 to shift the cable 118 to the left, FIGS. 4 and 7, when the drive member is rotated in a clockwise direction as viewed in FIGS. 4 and 7. The cable 118 extends through passage 96, through an end fitting 122 having a cross-section matching that of the section 92 and groove 94, and into a flexible sheath 124 secured to the end fitting 122. A second flexible cable 126 is wrapped around the drive member 104 in a direction opposite the cable 118 and extends around periphery 117 through the groove 114 into the slot 112. An abutment 128 secured to the free end of the cable 126 is engageable with the other closed end of the slot 112 to rotate the drive member 104 clockwise, FIGS. 4 and 7, when the cable 126 is shifted to the left as viewed in these Figures. The cable 126 is secured to a plastic fitting 130 which is slidable in the groove 102. The fitting 130 is connected in a suitable manner to a conventional power actuator, either vacuum, hydraulic or electric, such as a motor or a solenoid, which is mounted within the tailgate 14 and is remotely controlled by either the driver or passenger through a suitable operator, such as a switch.

The base member 76 and the secondary member 78 are riveted together at 132. The secondary member 78 is generally planar and includes an integral circular lug 134 received within a circular opening in the wall 80 as shown in FIG. 6 to align the members 76 and 78. Another integral circular lug, not shown, of member 78 is received within the recess 100, but is spaced from the base thereof to permit passage of the cable 126 below the lug. The member 78 includes an offset 136, FIGS. 4 and 5, having a recess matching section 92 and groove 94 to house the fitting 122 at the one end of the sheath 124. An arcuate closed slot 138 in the member 78 receives a reduced diameter hub 140 of a roller 142 which is pivotally mounted on a headed shouldered pin 144 secured to the drive member 104 as shown in FIG. 6. The roller 142 is normally located adjacent a side edge 146 of the cam member 56 as shown in FIG. 2.

Figure 11:
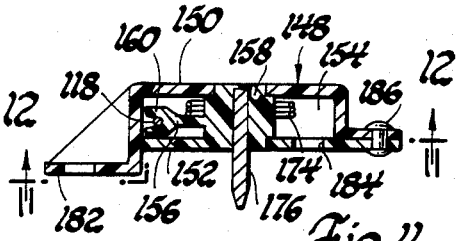
FIG. 11 is a view taken along line 11—11 of FIG. 9.
Figure 9:
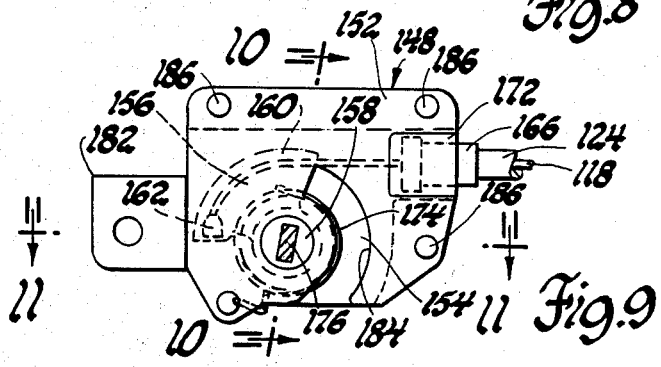
FIG. 9 is a view of the driven member.

As shown in FIGS. 9 through 12, a second housing 148 includes a base member 150 and a secondary member 152 of plastic material. The base member 150 has a recess 154 which rotatably receives a sector shaped driven member 156 of plastic material. The driven member includes an integral shouldered hub 158 as shown in FIG. 11 which is rotatably mounted within circular openings in the base member 150 and in the secondary member 152. The driven member further includes a grooved pulley portion 160 which receives the other end of the cable 118. An abutment 162 on the cable is received in a pocket 164 to secure cable 118 to the driven member. An end fitting 166 on the other end of the sheath 124 is the same as the end fitting 122 and received within a section 168 and groove 170 in the member 150 and in an enlargement 172 of member 152. A coil torsion spring 174 surrounds the hub 158 and is anchored between the driven member 156 and a flanged leg of the member 150 as shown in FIG. 9 to continuously bias the driven member 156 in counterclockwise direction to in turn shift the cable 118 toward the housing 148 or to the left as viewed in FIG. 9. The cable 118 rotates the drive member 106 counterclockwise as viewed in FIGS. 4 and 7 to engage the hub 140 of the roller 142 with one end of the slot 138 as shown and thereby locate the drive member and the driven member in a nonoperating position.

The housing 148 is suitably secured to the latch 18. This latch is generally the same as the latch 28 in that it includes a fork type bolt which is engageable with a U-shaped striker on the vehicle body adjacent the lower edge of the opening 12, with the bolt being held in latched position by a hook shaped detent. An output member 176, molded in the hub 158 of the driven member 156, is engageable in a rectangular slot 178 in a hub of a cam member 180 to rotate the cam member when the driven member is rotated clockwise as viewed in FIG. 9. The cam member 180 releases the detent member relative to the bolt of latch 18 to release the tailgate from the body.

Figure 12:
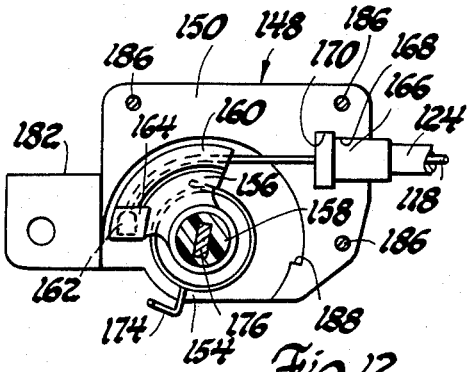
FIG. 12 is a broken away view of FIG. 9.

The base member 150 includes an integral offset apertured pad 182 to mount the housing 148 to the latch 18. The secondary member 152 includes an access slot 184. This member and the base member 150 are riveted together at a number of places 186, with one of the rivets 186 securing the flanged leg of the member 150 to the member 152. This is the leg that anchors one end of the spring 174. As shown in FIG. 12, the recess 154 includes a shoulder 188 which provides a stop for counterclockwise movement of the driven member 156.

If it is desired to release the window 22 for movement to open position, a suitable key is inserted in the lock cylinder 70 and the barrel of the lock cylinder is rotated in a counterclockwise direction. This will rotate the cam member 56 in the same direction against the bias of spring 62. The camming engagement of the edge 190 of the cam member 56 with the leg 54 of lever 48 rotates the lever counterclockwise of pivot 50 to its dash line position. The engagement of tab 52 on the end of leg 46 with the detent 38 rotates the detent clockwise as viewed in FIG. 3 to release the bolt 36 for counterclockwise movement to unlatched position under the bias of spring 42. An edge 192 of the bolt 36 engages a lateral tab 194 of side frame 32 to locate the bolt in unlatched position.

If it is desired to release the tailgate 14 from the exterior of the body for movement to open position, the barrel of the lock cylinder is rotated in a clockwise direction as viewed in FIG. 2. The camming engagement of the edge 146 with the roller 142 moves the roller upwardly or in a clockwise direction within slot 138, as viewed in FIGS. 4 and 7, to rotate the drive member 104 in this same clockwise direction. The engagement of the abutment 120 with the one or right hand end of slot 112 of the drive member shifts the cable 118 to the left as viewed in FIGS. 4 and 7 to in turn rotate the driven member 156 clockwise as viewed in FIG. 9. The clockwise rotation of the drive member 104 will have no effect on release of the latch 28 since the release lever 48 will remain in the full line position shown in FIG. 2. The clockwise rotation of the driven member 156 results in release of the latch 18, as previously described, so the tailgate can be opened. As the drive member 104 rotates clockwise as viewed in FIGS. 4 and 7 the other end of the slot 138 moves apart from the abutment 128 and the cable 126 remains stationary. Thus, the actuator secured to the fitting 130 remains in a non-operating mode.

If it is desired to release the tailgate 14 from inside the body for movement to open position, the actuator secured to fitting 130 is actuated. Such actuation shifts the fitting 130 to the left as viewed in FIGS. 4 and 7 or to the right as viewed in FIGS. 4 and 8 to again rotate the drive member clockwise due to the engagement of abutment 128 with the other or right hand end of slot 112 and release the latch 18 as previously described. During this movement, the cam member 56 is stationary and the roller 142 moves apart from the edge 146.

Thus this invention provides an improved vehicle body latch release arrangement for selectively releasing a plurality of vehicle body latches.

We claim:

1. In a vehicle body including first and second closure latch means and first and second release means for respectively releasing the first and second latch means upon actuation thereof, a latch release actuator arrangement comprising, in combination, a rotatable cam member mounted on the vehicle body, means on the cam member operative to actuate the first release means to effect release of the first latch means upon rotation of the cam member in one direction, first and second spaced housings mounted on the vehicle body, a flexible elongate conduit connecting the first and second housings, first and second rotatable members respectively rotatably mounted in said first and second housings, means operative to actuate the second release means to effect release of the second latch means upon rotation of the second rotatable member, a flexible elongate member extending between the first and second housings through the conduit, means connecting the flexible member to the first and second rotatable members to effect concurrent rotational movement thereof upon movement of the flexible member within the conduit, means on the first rotatable member engageable by the cam member upon rotation of the cam member in a direction opposite the one direction to rotate the first rotatable member and move the flexible member within the conduit to effect concurrent rotation of the second rotatable member, resilient means operative between the second rotatable member and the housing thereof to resist rotation of the second rotatable member and bias the first rotatable member in the one direction through the first elongate member, means operative between the first rotatable member and the first housing to locate the first rotatable member in a predetermined first position relative to the cam member against the bias of the resilient means and thereby locate the second rotatable member in a predetermined first position, and power actuating means selectively connectable to the first rotatable member for rotating the first rotatable member independently of rotative movement of the cam member, the first rotatable member effecting concurrent rotation of the second rotatable member through the flexible member.

2. In a vehicle body including a closure movable between open and closed positions with respect to the body, a window movable between open and closed positions with respect to the closure, first latch means locking the window to the closure, second latch means locking the closure to the body, and first and second release means for respectively releasing the first and second latch means upon actuation thereof, a latch release actuator arrangement comprising, in combination, a first annular drive member and a second annular driven member rotatably mounted on the closure, a first flexible cable member wrapped around each of the drive and driven members and secured thereto for conjoint rotation thereof, the drive member being rotatable from a first position to a second position and the driven member being conjointly rotatable from a first position to a second position, means on the driven member for actuating the second release means to effect release of the second latch means upon rotation of the driven member to the second position, means locating the drive member in the first position and resisting rotation thereof to the second position, a key operated member mounted on the closure for rotation in opposite directions from a first position to second and third positions, means actuating the first release means to effect release of the first latch means upon rotation of the key operated member from the first position to the second position, cooperating means on the key operated member and drive member movable into engagement upon rotation of the key operated member from the first position to the third position to rotate the drive member from the first position to the second position and conjointly rotate the driven member from the first position to the second position, an actuator mounted on the closure, cooperating means on the actuator and the drive member movable into engagement upon operation of the actuator to rotate the drive member from the first position to the second position and conjointly rotate the driven member from the first position to the second position, the rotation of the drive member to the second position by the key operated member moving the second cooperating engageable means on the drive member and actuator apart relative to each other, the rotation of the drive member to the second position by the actuator moving the cooperating engageable means on the key operated member and drive member apart whereby operation of the key operated member selectively and alternately actuates the release means of the first or second latch means independently of operation of the actuator and operation of the actuator releases the second latch means independently of operation of the key operated member.

3. In a vehicle body including a closure movable between open and closed positions with respect to the body, a window movable between open and closed positions with respect to the closure, first latch means for locking the window to the closure, and second latch means locking the closure to the body, and first and second release means for respectively releasing the first and second latch means, a latch release actuator arrangement comprising, in combination, a first annular drive member and a second annular driven member rotatably mounted on the closure, the drive member being rotatable from a first position to a second position and the driven member being rotatable from a first position to a second position, a first flexible member wrapped around the periphery of each of the drive and driven members and secured thereto for conjoint rotation thereof, means on the driven member for actuating the second release means to release the second latch means upon rotation of the driven member to the second position by the drive member, means locating the drive member in the first position and resisting rotation thereof to the second position, a key operated member rotatable in opposite directions from a first position to second and third positions, means actuating the first release means to release the first latch means upon rotation of the key operated member from the first position to the second position, cooperating means on the key operated member and drive member movable into engagement with each other upon rotation of the key operated member from the first position to the third position to rotate the drive member to the second position and conjointly rotate the driven member to the second position, an actuator mounted on the closure and including a second flexible member wrapped around the drive member in a direction opposite the direction of wrapping of the first flexible member, cooperating means on the drive member and the second cable member movable into engagement with each other upon operation of the actuator to rotate the drive member from the first position to the second position and conjointly rotate the driven member from the first position to the second position, the rotation of the drive member to the second position by the key operated member moving the cooperating means on the drive member and second cable member apart, the rotation of the drive member to the second position by the actuator moving the cooperating means on the key operated member and drive member apart whereby operation of the key operated member selectively and alternately releases the first or second latch means independently of operation of the actuator and operation of the actuator releases the second latch means independently of operation of the key operated member.

* * * * *